US005137490A

United States Patent [19]

Ishikawa et al.

[11] Patent Number: 5,137,490

[45] Date of Patent: Aug. 11, 1992

[54] VENTILATING EQUIPMENT FOR RAILWAY ROLLING STOCK AND OPERATING METHOD THEREOF

[75] Inventors: Shinichirou Ishikawa, Tokuyama; Toshiharu Matsuda, Nishinomiya; Haruo Hirakawa; Hiroshi Higaki, both of Kudamatsu; Atsushi Ikio, Tokuyama; Masakazu Matsumoto, Kudamatsu, all of Japan

[73] Assignee: Hitachi, Ltd., Tokyo, Japan

[21] Appl. No.: 672,040

[22] Filed: Mar. 19, 1991

[30] Foreign Application Priority Data

Mar. 19, 1990 [JP] Japan ..... 2-67035

[51] Int. Cl.[5] ..... B61D 27/00

[52] U.S. Cl. ..... 454/75; 454/105

[58] Field of Search ..... 454/70, 75, 105

[56] References Cited

U.S. PATENT DOCUMENTS 3,563,155 2/1971 Ishizawa ..... 454/105

FOREIGN PATENT DOCUMENTS 234297 1/1987 European Pat. Off. .
326044 1/1989 European Pat. Off. .
2658882 6/1978 Fed. Rep. of Germany ..... 454/105
227852 10/1987 Japan .

*Primary Examiner*—Harold Joyce
*Attorney, Agent, or Firm*—Antonelli, Terry, Stout & Kraus

[57] ABSTRACT

Ventilating equipment for railway rolling stock including a low-pressure supply air blower, a high-pressure supply air blower, a low-pressure exhaust air blower, and a high-pressure exhaust air blower. This ventilating equipment ventilates car interior during travel of a train outside of tunnels by the low-pressure supply air blower and the low-pressure exhaust air blower, and also ventilates the car interior during travel in tunnels by the high-pressure supply air blower and the high-pressure exhaust air blower. The high-pressure supply air blower and the high-pressure exhaust air blower produce a higher discharge pressure than a changing external pressure during a high-speed travel in tunnels, thereby preventing the propagation of an influence of the changing external pressure into the car interior. Furthermore, the ventilating equipment is capable of preventing an increase in power consumption of the entire ventilating equipment by interlocking, or changing over, between the high-pressure supply air blower and the high-pressure exhaust air blower and the low-pressure supply air blower and the low-pressure exhaust air blower, and is also capable of continuous ventilation of the car interior during travel in tunnels.

13 Claims, 3 Drawing Sheets

VENTILATING EQUIPMENT FOR RAILWAY ROLLING STOCK AND OPERATING METHOD THEREOF

BACKGROUND OF THE INVENTION

1. Field of the Invention

The present invention relates to ventilating equipment for railway rolling stock and an operating method thereof and, more particularly, to ventilating equipment for railway rolling stock suitable for use on a high-speed train in which there takes place a change in atmospheric pressure outside of cars of the train which makes passengers feel uncomfortable.

2. Description of the Prior Art

When the rolling stock train) is running at a high speed in a tunnel, the external pressure of the train (a pressure outside of the cars) in the tunnel changes. Particularly a value of external pressure fluctuation of the train reaches a maximum when trains pass each other in the tunnel. For example, when the train is running in a tunnel at a running speed of 200 km/h and the ratio of sectional area of the car to the tunnel is 0.23, the external pressure fluctuation value is about 150 $mmH_2O$ on the positive pressure side and about 400 $mmH_2O$ on the negative pressure side. Generally, the external pressure fluctuation value increases in proportion to a square of the running speed of the train. If such a pressure change propagates into the cars of the train, ear discomfort is experienced by the passengers. To overcome this problem of propagation of the pressure change into the cars, conventional cars are built airtight and equipped with a ventilating equipment. The ventilating equipment has a ventilating air volume necessary for holding the concentration of $O_2C$ in the cars, i.e. a required ventilating air volume. There is an example of this ventilating equipment disclosed in Japanese Utility Model Registration No. 1287276 (counterpart of U.S. Pat. No. 3,563,155). The ventilating equipment that has been put into practical use, air blowers comprising a supply air means and an exhaust air means have a capacity of delivering the maximum pressure of 540 $mmH_2O$ and the air volume of 30 $m^3$/min. The car provided with this ventilating equipment has the inside capacity of a car body of about 150 $m^3$ and the seating capacity of 100 passengers on both sides. In this ventilating equipment the discharge pressure of the blower is set higher than the variation value of the external pressure. To operate the train at a higher speed, it is necessary to increase the discharge pressure of the air blowers. However, for improving the discharge pressure of the air blowers, it is imperative to build large-sized air blowers and, accordingly, to increase a power consumption for driving these blowers.

Alternative ventilating equipment is proposed in Laid-Open Japanese Patent Application No. 62-227852, wherein air flow paths are designed to be closed or contracted when trains pass each other in a tunnel. However, when it is presumed that the train is running at a speed of 400 km/h, a fluctuation value of the maximum pressure during travel in the tunnel is supposed to reach 1600 $mmH_2O$. Even under the condition that the train is traveling in a tunnel without passing by any oncoming train, the value of pressure change may reach 600 $mmH_2O$. It is, therefore, necessary to close the air flow paths of the ventilating equipment while the train is running in the tunnel. Besides, in this ventilating equipment, the ventilating air volume is prone to decrease with the improvement of car speeds.

Furthermore, another prior-art ventilating equipment disclosed in Laid Open Japanese Patent Application No. 62-203868 is provided with turbocompressors as air supply and exhaust means. The turbocompressor is capable of obtaining a great discharge pressure over a fluctuation value of an external pressure of cars during high-speed running. The turbocompressor, however, decreases in efficiency when operated to supply the amount of air equivalent to a required ventilating air volume at a low discharge pressure The turbocharger stated above, therefore, requires much more power than a blower in use in ordinary ventilating equipment. In the meantime, the rolling stock has the problem that the feed efficiency decreases with the improvement of the running speed. In the high-speed running train, therefore, it is undesirable to increase the power consumption in the ventilating equipment.

It is an object of the present invention to provide a ventilating equipment for rolling stock capable of continuously ventilating the cars without increasing the power consumption when the car running speed increases, and a method of operating the same.

SUMMARY OF THE INVENTION

Ventilating equipment according to the present invention comprises a high-pressure ventilating system including a high-pressure air supply means and a high-pressure, air exhaust means, a lower-pressure ventilating system including a low-pressure air supply means having a lower discharge pressure than the high-pressure air supply means and a low-pressure air exhaust means having a lower discharge pressure than the high-pressure air exhaust means, and cutoff means for closing the air flow paths of the low-pressure ventilating system. This ventilating equipment is designed to perform ventilation of car interior by the high-pressure ventilating system when the train is running in a tunnel, thereby preventing a fluctuation in the interior pressure in the cars. Furthermore according to the present invention, the ventilation of the car interior can be continuously performed during running. Additionally, according to this ventilating equipment, it is possible to prevent increasing power consumption of the entire ventilating equipment.

The method of operating the ventilating equipment according to the present invention comprises detecting the state of change in the external pressure during running and closing an air flow path cutoff means installed in the low-pressure ventilating means which, together with the high-pressure ventilating means, constitutes the ventilating equipment, according to the state of change in the external pressure of the cars.

The operating method of this ventilating equipment is for operating to close the supply air cutoff means and the exhaust air cutoff means in accordance with the changing state of the external pressure. According to the ventilating equipment and its control method, the ventilation of car interior during running in a tunnel is performed by means of the high-pressure air supply means and the high-pressure air exhaust means. Therefore, according to the method of operating this ventilating equipment, ventilation can be done continuously without changing the interior pressure of the car during travel in a tunnel. This ventilating equipment operating method will not increase the power consumption even during travel in the tunnel as compared with the ventilating equipment equipped with the turbocompressor.

Other and further objects and features of the present invention will appear more fully from the following description.

DESCRIPTION OF THE PREFERRED EMBODIMENTS

Figure 1:
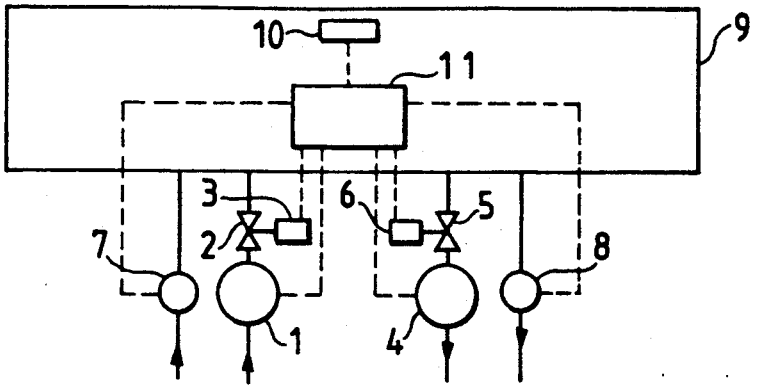
FIG. 1 is a schematic view for an air flow path according to a first embodiment of the present invention.
Figure 2:
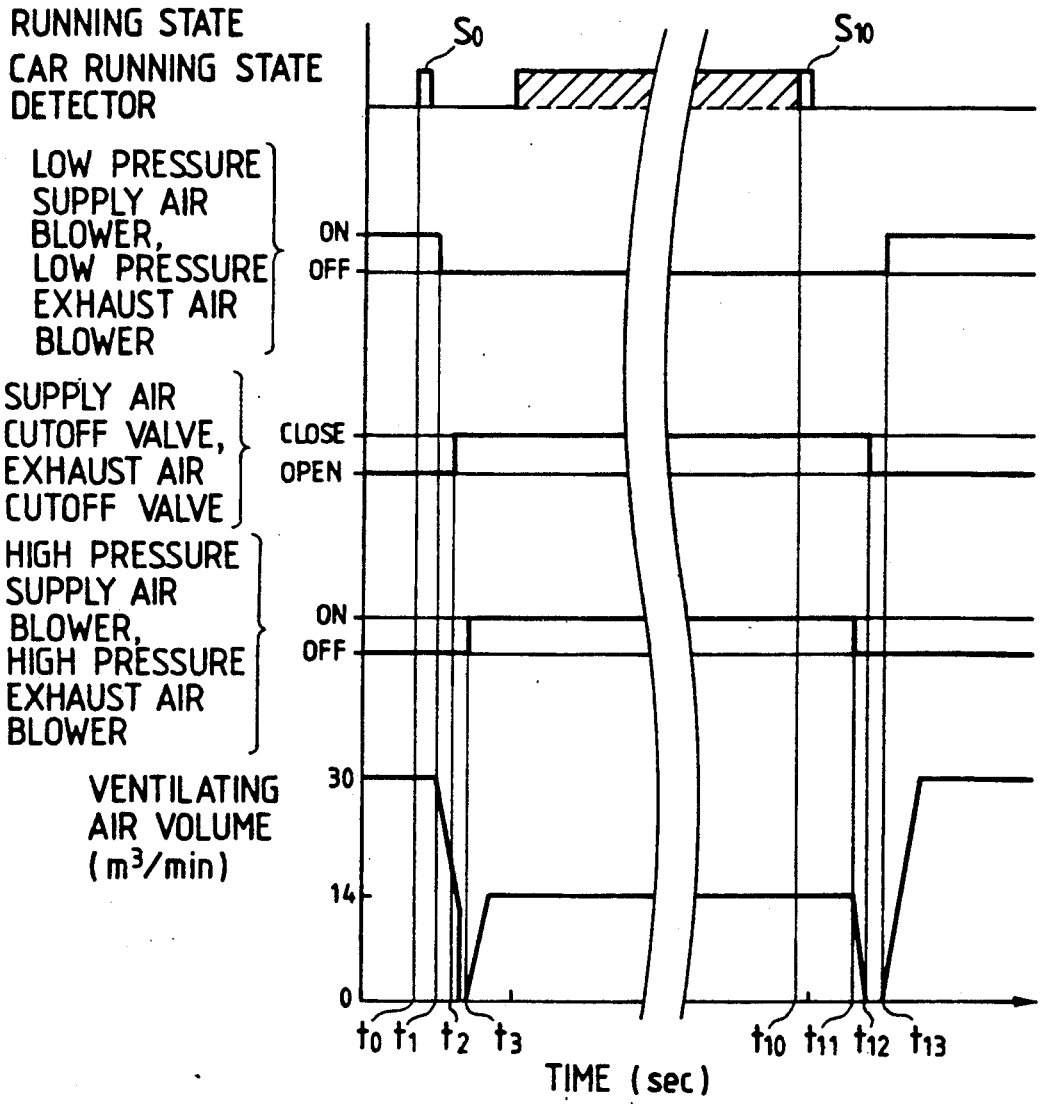
FIG. 2 is a graphical view showing the controlled state of various equipment according to the first embodiment of the present invention.
Figure 3:
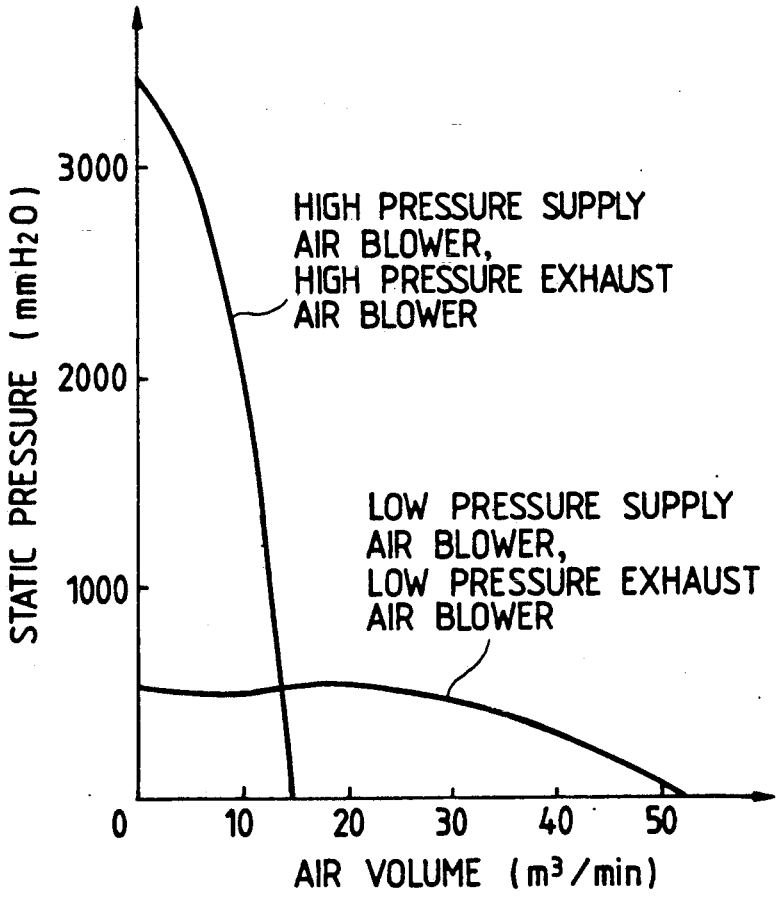
FIG. 3 is a graphical illustration of the pressure characteristics of two types of air blowers used in the first embodiment of the present invention.

Referring to FIGS. 1 to 3, a car body 9 an airtight construction throughout, will be explained on the assumption that it has the inner volume of 150 $m^3$ and the seating capacity of 100 persons. The car including the car body 9 is designed to run at a maximum running speed of 400 km/h, with each car body 9 requiring a ventilating air volume of 30 $m^3$/min. A low-pressure supply air blower 1 draws outside air, i.e. fresh air into the car an has a capacity of discharging a maximum pressure of 540 $mmH_2O$ and supplying a rated air volume of 30 $m^3$/min. The discharge pressure of the low-pressure supply air blower 1 is set at a pressure necessary for conducting the fresh air into the cars when the train runs on a route other than a tunnel. That is, the discharge pressure of the low-pressure supply air blower 1 is determined with a flow path resistance primarily of the low-pressure supply air blower 1 and a little pressure change acting on the outside surface of the car body 9 when the train runs on a route other than the tunnel. Also the supply air volume of the low-pressure supply air blower 1 is set so as to be equal to the ventilating air volume required by the car body 9. Cutoff valve 2 on the supply air side is installed in the air flow path of the lower-pressure supply air blower 1 with an actuator 3 being provided for opening and closing the cutoff valve 2.

A low-pressure exhaust air blower 4 which discharges dusty air from the car interior out of the car body 9, and has a capacity for delivering a maximum pressure of 540 $mmH_2O$ and blowing a rated quantity of air of 30 $m^3$/min. A cutoff valve 5 on the exhaust side is installed in the air flow path of the low-pressure exhaust air blower 4, with an actuator 6 for opening and closing the cutoff valve 5.

A high-pressure supply air blower draws the outside fresh air into cars. This high-pressure supply air blower 7 has a capacity for delivering a maximum pressure or 3400 $mmH_2O$ and blowing a rated quantity of air of 14 $m^3$/min. The discharge pressure of the high-pressure supply air blower 7 is set at a higher value than the maximum fluctuation value of the external pressure which occurs when the train passes by an oncoming train at a maximum speed in a tunnel. The air volume supplied from the low-pressure supply air blower 1 is set lower than that supplied from the low-pressure supply air blower 1 for the purpose of preventing increasing the power consumption of the entire ventilating equipment. Furthermore, the volume of air supplied by the high-pressure supply air blower 7 is set at a value equal to, or less than, that supplied by a blower of a ventilating equipment in practical use because of the prevented increase of power consumption thereof. A high-pressure exhaust air blower 8 discharges dusty air out from the inside of the cars. This high-pressure exhaust air blower 8 has a capacity of a maximum discharge pressure of 3400 $mmH_2O$ and a rated supply air volume of 14 $m^3$/min.

The pressure characteristics of the low-pressure supply air blower 1, the low-pressure exhaust air blower 4, the high-pressure supply air blower 7 and the high-pressure exhaust air blower 8 are shown in FIG. 3. The low pressure supply air blower 1 and the low-pressure exhaust air blower 4 have the characteristics that the blowers 1, 2 deliver much volume of air at a low discharge pressure. Also the high-pressure supply air blower 7 and the high-pressure exhaust air blower 8 have the characteristics of delivering a small volume of air at a high discharge pressure.

A car running state detector 10 predetects the changing state of the external pressure during the running of the train. External pressure fluctuation during running increases from the point of time when the train enters a tunnel. Therefore the car running state detecting means 10 is required to detect the train approaching a tunnel before the train rushes into the tunnel. To obtain this function, the car running state detector 10 includes a transmitter on the entrance side which is located on a track near the entrance of a tunnel and transmits a radio or sonic signal, and a receiver, installed on the car body 9, which receives a signal from the transmitter on the tunnel entrance side. This car running state detector 10 is able to detect the approach of the train to the tunnel through the operation of the transmitter and the receiver. At the exit of the tunnel is installed a transmitter for the exit side for the detection of time when the train goes out of the tunnel. The transmitter on the exit side functions to transmit a radio or sonic signal similarly to the transmitter on the entrance side. These transmitters on the entrance and exit sides give off signals at different frequencies to allow easy discrimination on the receiving side.

A controller 11 controls the low-pressure supply air blower 1, the low-pressure exhaust air blower 4, the actuator 3, the actuator 6, the high-pressure supply air blower 7 and the high-pressure exhaust air blower 8. The controller 11 includes a plurality of relays and is a microcomputer, and designed to start controlling in accordance with a control command from the car running state detector 10. Control to be conducted by this controller 11 will hereinafter be explained in detail. A hatched part at the top of FIG. 2 indicates a time during which the train is running in a tunnel. At the bottom is given the transition of a ventilating air volume in cars. In the middle of FIG. 2 is shown the state of operation of the low-pressure supply air blower 1, the low-pressure exhaust air blower 4, the cutoff valves 2 and 5, the high-pressure supply air blower 7 and the high-pressure exhaust air blower 8. The car running state detecting means 10 outputs a control command $S_0$ to the controller 11 when the train equipped with the aforementioned ventilating equipment running at a high speed is approaching a tunnel ($T_0$). The controller, receiving the control command from the car running state detecting means 10, stops both the low-pressure supply air blower 1 and the low-pressure exhaust air blower 4 at the same time ($T_1$) and then outputs a cutoff command to the actuators 3 and 6 to close the cutoff valves 2 and 5 ($T_2$). The cutoff valves 2 and 5 function to close the air flow paths of the low-pressure supply air blower 1 and the low-pressure exhaust air blower 4 through the operation of the actuators 3 and 6. Furthermore, the controller 11, after giving off the cutoff command to the actuators 3 and 6, outputs an operation command to the high-pressure supply air blower 7 and the high-pressure exhaust air blower 8 ($T_3$). The high-pressure supply air blower 7 and the high-pressure exhaust air blower 8, receiving this operation command from the controller 11, start operating. These blowers 7 and 8 start to supply a rated volume of air at a rated discharge pressure at the point of time when the train goes into a tunnel. The car running state detector 10 outputs a control command to the controller 11, taking into consideration the time required by the high-pressure supply air blower 7 and the high-pressure exhaust air blower 8 to reach a rated operating state after the start of operation. The transmitter of the car running state detecting means 10 is located before the tunnel entrance so as to ensure a time required by the high-pressure air blowers 7 and 8 to reach the rated operating state. These high-pressure air blowers 7 and 8, therefore, start their rated operation when the train enter the tunnel.

Next, the operating state of the aforementioned equipment when the train goes out of the tunnel will be explained. The car running state detector 10 detects the outgoing of the train from the tunnel in accordance with a signal the receiver receives from the transmitter located on the exit side. The car running state detector 10 outputs a control command $S_{10}$ to the controller 11 ($T_{10}$). The controller 11 first stops the high-pressure supply air blower 7 and the high-pressure exhaust air blower 8 in accordance with the control command from the car running state detector 10 ($T_{11}$). Next, the controller 11 outputs a control command to the actuators 3 and 6 ($T_{12}$). The actuators 3 and 6 operate to open the cutoff valves 2 and 5 in accordance with the control command from the controller 11. In this state, the controller 11 outputs an operation command to the low-pressure supply air blower 1 and the low-pressure exhaust air blower 4 ($T_{13}$). The low-pressure supply air blower 1 and the low-pressure exhaust air blower 4 ventilate the car interior until the train approaches the next tunnel.

According to the ventilating equipment, the air flow paths of the low-pressure ventilating means comprising the low-pressure supply air blower 1 and the low-pressure exhaust air blower 4 are kept closed during the period when the train is running in the tunnel. The air flow path of the low-pressure ventilating means is closed by the air flow path cutoff means comprising the cutoff valves 2 and 5. Also, according to this ventilating equipment, the car interior is being ventilated by use of the high-pressure supply air blower 7 and the high-pressure exhaust air blower 8 during a period when the train is running in a tunnel. That is, the ventilating equipment of the present invention performs the ventilation of the car interior by the high-pressure ventilating means including the high-pressure supply air blower 7 and the high-pressure exhaust air blower 8 when the train is running in a tunnel. Therefore, according to this ventilating equipment, it is possible to prevent the propagation of exterior pressure change into the cars during the high-speed travel of the train in the tunnel. That is, since the high-pressure supply air blower 7 and the high-pressure exhaust air blower 8 produce a greater discharge pressure than the maximum fluctuation value of the external pressure, the volume of air to be supplied will never be subjected to a large change in the event of a change in the external pressure. The air pressure in the cars will not change when the air volume of the high-pressure supply air blower 7 and the high-pressure exhaust air blower 8 does not change, accordingly giving no effect of air pressure fluctuation to the passengers in the cars. Furthermore, since the low-pressure ventilating means comprising the low-pressure supply air blower 1 and the low-pressure exhaust air blower 4 and the high-pressure ventilating means comprising the high-pressure supply air blower 7 and the high-pressure exhaust air blower 8 are changed over in operation, it is possible to reduce the power consumption of the entire ventilating equipment more than a ventilating equipment using a turbocompressor. In the ventilating equipment according to the present invention, the power consumption much the same as conventional types of ventilating equipment in actual use. According to this ventilating equipment, the interior of the car body 9 is continuously ventilated even during travel in tunnels.

In the above-mentioned high-pressure supply air blower 7 and the high-pressure exhaust air blower 8, the rated air volume is less than the required ventilating air volume, and accordingly, for a train equipped with this ventilating equipment and running at a maximum speed in a tunnel, the maximum passable length of the tunnel is about 20 km and the rate of occupation of the tunnel to the route is about 33%.

In the embodiment described above, the use of an alternative car running state detector may be considered for the predetection of a changing state of the external pressure of cars. For example, there may be used, as the running state detector, a memory system which stores tunnel position and length on a route along which the train travels, and an output system which reads out information stored in the memory system on the basis of a distance covered by the train. The car running state detector outputs a control command from the output system to the controller 11 at the point of time when the train has approached a position where there is provided a time required by each blower before it reaches its rated state of operation. The car running state detector has a function of computing the time to exit the tunnel on the basis of the running speed of train and the tunnel length. This car running state detector outputs a control command to the controller 11 at the time of exit from the tunnel in accordance with a result of the above-mentioned computation.

Furthermore, in the embodiment described above, the car running state detector may be a pressure detector which detects the external pressure of the car body 9. When this pressure detector is employed as the car running state detector, the controller 11 starts to operate after the train has entered a tunnel, and therefore a change in the external pressure will propagate into the car interior. In this case, the influence of this change in the external pressure can be held to a minimum by reducing the operating speed of the actuators 3 and 6 and the cutoff valves 2 and 5. When the external pressure change propagates into the car interior, the low-pressure supply air blower 1 and the low-pressure exhaust air blower 4 work as a resistance.

The above-described two examples of car running state detectors are inexpensive and of simple construction because all equipment constituting the car running state detector are mounted on the train. Also these two examples of the car running state detectors feature easy maintenance and high reliability.

Figure 4:
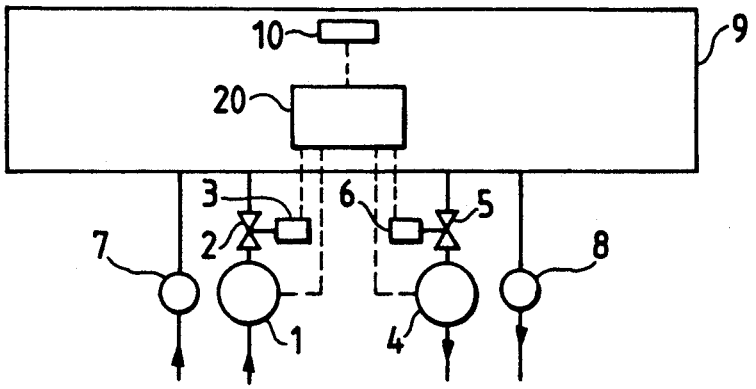
FIG. 4 is a schematic view for an air flow path according to a second embodiment of the present invention.
Figure 5:
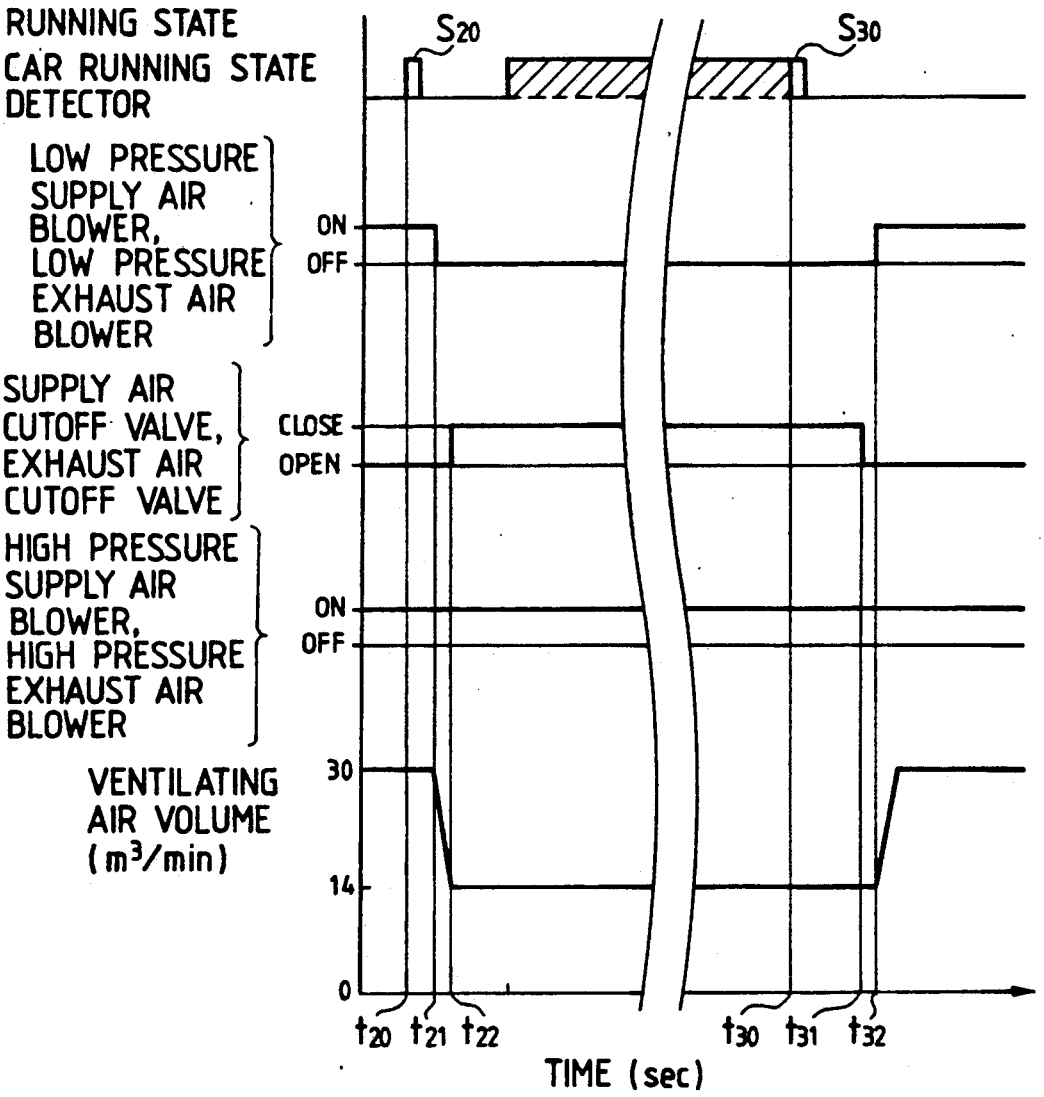
FIG. 5 is a graphical view showing the controlled state of equipment according to the second embodiment of the present invention.

Next, the ventilating equipment according to a second embodiment of the present invention will hereinafter be explained with reference to FIGS. 4 and 5. This ventilating equipment, as in the first embodiment, includes the low-pressure supply air blower 1, the low-pressure exhaust air blower 4, the high-pressure supply air blower 7, the high-pressure exhaust air blower 8, the supply air cutoff valve 2, the exhaust air cutoff valve 5, the actuator 3, the actuator 6, and the car running state detector 10. In the ventilating equipment according to the embodiment of FIGS. 4 and 5, however, a controller 20 is different from the controller 11 of the first embodiment. This controller 20 controls the low-pressure supply air blower 1, the low-pressure exhaust air blower 4, the actuator 3 and the actuator 6, and does not control the high-pressure supply air blower 7 and the high-pressure exhaust air blower 8. The high-pressure supply air blower 7 and the high-pressure exhaust air blower 8 are connected to the main power supply of the ventilating equipment, operating in an interlock with the main power supply. When the main power supply of the ventilating equipment, therefore, is on, the high-pressure supply air blower 7 and the high-pressure exhaust air blower 8 are constantly operated. This embodiment is the same as the first embodiment in the specifications of the car body 9 and the running speed of train.

Next the operating state of this ventilating equipment will be explained with reference to FIG. 5. As the train approaches a tunnel, the car running state detector 10 outputs a control command $S_{20}$ to the controller 20 ($T_{20}$). The controller 20 serves to stop the low-pressure supply air blower 1 and the low-pressure exhaust air blower 4 ($T_{21}$). Thereafter, the controller 20 outputs a cutoff command to the actuators 3 and 6 to close the cutoff valves 2 and 5 ($T_{22}$). The cutoff valves 2 and 5 are closed by the operation of the actuators 3 and 6, thereby closing the air flow paths of the low-pressure supply air blower 1 ad the low-pressure exhaust air blower 4. In the embodiment of FIGS. 4 and 5, as in the first embodiment, the car interior is ventilated by a high-pressure supply air blower 30 and a high-pressure exhaust air blower 31 when the train is running in a tunnel. After the exit of the train from the tunnel, the car running state detecting means 10 outputs a control command $S_{30}$ to the controller 20 ($T_{30}$). The controller 20 outputs a control command to the actuators 3 and 6 to open the cutoff valves 2 and 5 ($T_{31}$), then operating a low-pressure supply air blower 21 and the low-pressure exhaust air blower 2 ($T_{32}$).

According to this ventilating equipment, it is possible to prevent a pressure change in the car interior during travel in tunnels as in the case of the embodiment of FIGS. 1-3 described above. Also it is possible to continuously ventilate the car interior during travel in tunnels. The ventilating equipment according to the embodiment of FIGS. 4 and 5 requires more power than that according to the first embodiment, but requires less power than conventional ventilating equipment equipped with a turbocompressor. Since this ventilating equipment does not use the controller 20 to control the high-pressure supply air blower 7 and the high-pressure exhaust air blower 8, it is possible to simplify the construction of the control system than that used in the ventilating equipment of the first embodiment. Furthermore, in this ventilating equipment, the high-pressure supply air blower 7 and the high-pressure exhaust air blower 8 are continuously operated, and therefore it is not necessary to take into consideration the time required by the high-pressure supply air blower 7 and the high-pressure exhaust air blower 8 before reaching the rated operation thereof. Therefore, this ventilating equipment is specially effective when a pressure detector is used as the car running state detector.

As has been described above, according to the ventilating equipment of the present invention and a control method thereof, an external pressure change will not propagate into the car interior if the train runs at a high speed in tunnels, and accordingly will not make the passengers feel uncomfortable. Furthermore, according to the ventilating equipment and the control method thereof, the equipment requires less power than conventional ventilating equipment having a turbocompressor, and can continuously ventilate the car interior.

What is claimed is:

1. A ventilating equipment for railway rolling stock, comprising:
   - a high-pressure supply air means having a higher discharge pressure than an external changing pressure during travel of a train;
   - a high-pressure exhaust air means having a higher discharge pressure than an external changing pressure during travel of a train;
   - a low-pressure supply air means having a lower discharge pressure than said high-pressure supply air means;
   - a low-pressure exhaust air means having a lower discharge pressure than said high-pressure exhaust air means;
   - a supply air cutoff means capable of opening and closing an air flow path of said low-pressure supply air means;
   - an exhaust air cutoff means capable of opening and closing an air flow path of said low-pressure exhaust air means; and
   - a control means for closing said supply air cutoff means and said exhaust air cutoff means in accordance with the changing state of external pressure during travel of a train.

2. A ventilating equipment for railway rolling stock as claimed in claim 1, wherein said low-pressure supply air means and said low-pressure exhaust air means have an air volume corresponding to a ventilating air volume required for ventilation of cars.

3. A ventilating equipment for railway rolling stock as claimed in claim 1, wherein said low-pressure supply air means and said low-pressure exhaust air means have an air volume corresponding to a ventilating air volume required for ventilation of cars, and said high-pressure supply air means and said high-pressure exhaust air means have a less air volume than said low-pressure supply air means and said low-pressure exhaust air means.

4. A ventilating equipment for railway rolling stock as claimed in claim 1, wherein said control means is provided with a car running state detecting means which predetects entrance of a train into a tunnel, and closes said supply air cutoff means and said exhaust air cutoff means in accordance with a result of detection by said car running state detecting means.

5. A ventilating equipment for railway rolling stock as claimed in claim 1, wherein said control means has a car running state detecting means which detects a duration of travel of a train in a tunnel, and closes said supply air cutoff means and said exhaust air cutoff means in accordance with a result of detection by said car running state detecting means.

6. A ventilating equipment for railway rolling stock, comprising:

a high-pressure supply air means having a higher discharge pressure than external changing pressure during travel of a train;

a high-pressure exhaust air means having a higher discharge pressure than changing external pressure during travel of a train;

a low-pressure supply air means having a lower discharge pressure than said high-pressure supply air means;

a low-pressure exhaust air means having a lower discharge pressure than said high-pressure exhaust air means;

a supply air cutoff means capable of opening and closing an air flow path of said low-pressure supply air means;

an exhaust air cutoff means capable of opening and closing an air flow path of said low-pressure exhaust means; and a control means which operates said supply air cutoff means and said exhaust air cutoff means in accordance with the changing state of the external pressure, stops said low-pressure supply air means and said low-pressure exhaust air means, and operates said high-pressure supply air means and said high-pressure exhaust air means.

7. A ventilating equipment for railway rolling stock as claimed in claim 6, wherein said control means is provided with a car running state detecting means which predetects entrance of a train into a tunnel, and actuates said supply air cutoff means and said exhaust air cutoff means in accordance with a result of detection by said car running state detecting means, thereby stopping said low-pressure supply air means and said low-pressure exhaust means, and operating said high-pressure supply air means and said high-pressure exhaust air means.

8. A ventilating equipment for railway rolling stock as claimed in claim 6, wherein said control means is equipped with a car running state detecting means which detects a duration of travel of a train in a tunnel, actuates said supply air cutoff means and said exhaust air cutoff means in accordance with a result of detection by said car running state detecting means to close said cutoff valves, and stops said low-pressure supply air means and said low-pressure exhaust means, and operating said high-pressure supply air means and said high-pressure exhaust air means.

9. A ventilating equipment for railway rolling stock as claimed in claim 8, wherein said car running state detecting means is a pressure detecting means mounted on a car body for detection of external pressure of said car body.

10. A ventilating equipment, comprising:

a high-pressure ventilating system including a high-pressure supply air means and a high-pressure exhaust air means;

a low-pressure ventilating system including a low pressure supply air means having a lower discharge pressure than said high-pressure supply air means and a low-pressure exhaust air means having a lower discharge pressure than said high-pressure exhaust air means; and supply air cutoff means which closes an air flow path of said low-pressure supply air means and exhaust air cutoff means which closes an air flow path of said low-pressure exhaust air means.

11. A method of operating a ventilating equipment for ventilation of a car interior, said method comprising the steps of:

detecting a changing state of an external pressure during travel of a train; and actuating air flow path cutoff means mounted in low-pressure ventilating means of said ventilating equipment including high-pressure ventilating means and low-pressure ventilating means in accordance with a changing state of external pressure.

12. A method of operating a ventilating equipment for a railway rolling stock as claimed in claim 11, further comprising the steps of operating said air flow path cutoff means mounted in said low-pressure ventilating means of said high-pressure ventilating means and said low-pressure ventilating means, and stopping said low-pressure ventilating means.

13. A method of operating a ventilating equipment for railway rolling stock as claimed in claim 11, further comprising the steps of:

operating said air flow path cutoff means mounted in said low-pressure ventilating means of said high-pressure ventilating means and said low-pressure ventilating means, and stopping said low-pressure ventilating means by changing over said low-pressure ventilating means and said high-pressure ventilating means.

* * * * *